US006200150B1

(12) United States Patent
Hsu

(10) Patent No.: US 6,200,150 B1
(45) Date of Patent: Mar. 13, 2001

(54) FLAT-CABLE-TYPE CONNECTOR HAVING AUXILIARY STRUCTURE TO ENHANCE CLAMPING FORCE

(75) Inventor: Jui-Yuan Hsu, Taoyuan Shien (TW)

(73) Assignee: Delta Electronics, Inc. (TW)

( * ) Notice: Subject to any disclaimer, the term of this patent is extended or adjusted under 35 U.S.C. 154(b) by 0 days.

(21) Appl. No.: 09/314,223

(22) Filed: May 18, 1999

(30) Foreign Application Priority Data

Jan. 29, 1999 (TW) ..... 88201528

(51) Int. Cl.[7] ..... H01R 13/15; H01R 13/62
(52) U.S. Cl. ..... 439/260
(58) Field of Search ..... 439/260, 267, 439/329, 864, 635

(56) References Cited

U.S. PATENT DOCUMENTS 3,114,587 * 12/1963 Herrmann ..... 439/329
5,402,316 * 3/1995 Volz et al. ..... 439/267
5,904,586 * 5/1999 Takayasu ..... 439/260

* cited by examiner

*Primary Examiner*—Neil Abrams
*Assistant Examiner*—Javaid Nasri

(57) ABSTRACT

A connector for connecting a first device with a second device through a combination thereof with a flat cable of the second device is disclosed. The connector includes a connecting head for receiving the flat cable therefrom; and an auxiliary device, located outside the connecting head for being exerted thereon a first directional force to clamp the flat cable in the connecting head, and a second directional force to release the flat cable from the connecting head. By providing such an auxiliary device to facilitate the clamping of the flat cable in the connecting head, the connector can be in good mechanical and electronic connection with a flat cable.

6 Claims, 6 Drawing Sheets

FLAT-CABLE-TYPE CONNECTOR HAVING AUXILIARY STRUCTURE TO ENHANCE CLAMPING FORCE

FIELD OF THE INVENTION

The present invention is related to a connector, and more particular to a connector structure having high connecting performance with a flat cable to improve signal transmission.

BACKGROUND OF THE INVENTION

A conventional connector 11 includes a clamp-type socket as a connecting member with a flat cable 12, as shown in FIG. 1. The clamp-type socket 101 includes two rows of elastic metal strips 102 arranged on inner surfaces thereof in a manner corresponding to a plurality of pins 103 of the flat cable 12, respectively, so as to permit mechanical and electric connection between the elastic metal strips 102 and the pins 103 after the flat cable 12 is inserted into the connector 11. Thereby, the connector can transmit a signal from an element connected therewith to another element connected with the flat cable. For example, the connector 11 can obtain power from a power supply 13 through wires (not shown), and transmit the power to a circuit board 14 through the combination of the metal strips 102 and the pins 103.

It is apparent, however, that in the conventional connector 11, the metal strips 102 clamp and secure the pins 103 therein only by elastic force of themselves. Consequently, the mechanical connection between the elastic metal strips 102 and the pins 103 is likely to be released owing to the weakening of the elastic force of the metal strips 102 so as to result in poor electric connection between the power supply 13 and the circuit board 14. The elastic force can be weakened for many reasons, such as natural decay or frequent plugged and unplugged operations.

Another kind of signal transmission is conducted by conductive layers as shown in FIG. 2 rather than the metal strips and wires as mentioned above. In FIG. 2, two conductive pieces 201 and 202 having therebetween an insulating layer 203 are connected to a power supply (not shown) by one end and to a connector 21 by another end. The two conductive pieces 201 and 202 are connected to two plates 211 and 212 of the connector 21, respectively, and the relative position of the two plates 211 and 212 are flexibly adjusted by a spring element 213. When a flat cable 22 of a circuit board 24 is inserted into the connector 21 from the entrance between the two plates 211 and 212 by a bare metal end 221 thereof, the spring element 213 props open the entrance to allow the flat cable 22 to enter the connector 21, and the flat cable 22 is able to be clamped between the two conductive pieces 201 and 202 by the elastic force of the spring element 213. Accordingly, power can be transmitted from the power supply to the circuit board. Such power transmission means has an advantage of eliminating the induction effect of wires. In other words, power can be transmitted in a condition of almost no induction so that a voltage drop ($\Delta V=L(di/dt)$) resulting from an instantaneous high current owing to a power-on or wake-up operation will not occur, and thus the quality of power supplying can be maintained. Such means is especially preferably applied to an electronic circuit of low voltage, e.g. a microprocessor of 3.3 volts or less.

The power transmission means as mentioned above, however, maintains the clamp relationship between the conductive pieces and the flat cable only by elastic force of the spring element. Therefore, the close contact between the conductive pieces and the flat cable is subject to change with the weakening of the elastic force of the spring element. Also, the elastic force can be weakened for many reasons, such as natural decay or frequent plugged and unplugged operations.

SUMMARY OF THE INVENTION

An object of the present invention is to provide a connector allowed to be in good mechanical connection with a flat cable.

Another object of the present invention is to provide a connector for improving electric connection between a flat cable and wires or conductive pieces.

The present invention is related to a connector for connecting a first device with a second device through a combination thereof with a flat cable of the second device. The connector includes a connecting head for receiving the flat cable therefrom; and an auxiliary device, located outside the connecting head for being exerted thereon a first directional force to clamp the flat cable in the connecting head, and a second directional force to release the flat cable from the connecting head.

Preferably, the auxiliary device includes a pillar element movably located on the connecting head; and a draw bar connected to the pillar element for being exerted thereon the first directional force to make a surface of the pillar element depress and sustain against the connecting head, and being exerted thereon the second directional force to make the surface of the pillar element rise and become away from the connecting head.

The draw bar preferably further includes a shaft penetrating through the pillar element; and a handle being a bent portion from a first end of the shaft outside the pillar element, and exerted thereon the first and the second directional forces to pivotally rotating the pillar element via the shaft.

In an embodiment, when the connector is assembled, the pillar element is located above the connecting head, and the auxiliary device further includes a base located below the connecting head and combined with the pillar element to clamp the connecting head therebetween.

For achieving this purpose, the base may include a base plate; a first post protruding from a first side of the base plate, and having a through hole for being inserted therethrough the shaft at a second end; and a second post protruding from a second side of the base plate, and having a hooked trench for being inserted therefrom and receiving therein the shaft at the first end. On the other hand, the connecting head may include a lower plate coupled to the first and the second posts by respective two sides thereof to be placed between the base plate and the pillar element; an upper plate engaged with the lower plate, and coupled to the first and the second posts by respective two sides thereof to be placed between the base plate and the pillar element; and an elastic element mounted between the upper and lower plates to adjustably engage the upper plate with the lower plate.

Preferably, the elastic element includes two springs arranged between the upper and lower plates at the two sides of the upper and lower plates to be coupled to the first and the second posts, respectively.

For transmitting signals between the first and the second devices, the connecting head may include two rows of elastic metal strips electrically connected to the first device through wires, and arranged on opposite surfaces of the upper and the lower plates, respectively. Accordingly, when the flat cable is inserted into the connecting head, the flat cable will be clamped between the two rows of elastic metal strips so as to allow signals to be transmitted between the first and the second devices.

Alternatively, the connecting head may be connected to the first device through two conductive pieces coupled to the upper and the lower plates, respectively, so that the flat cable is clamped between the two conductive pieces to transmit signals between the first and the second devices when the flat cable is inserted into the connecting head.

On the other hand, the auxiliary device preferably further includes a force-dispersion plate coupled to the first and the second posts by respective two sides thereof, and arranged between the upper plate and the pillar element to assure of an even depression force transmitted from the pillar element to the upper plate when the first directional force is exerted.

BRIEF DESCRIPTION OF THE DRAWING

The present invention may best be understood through the following description with reference to the accompanying drawings, in which.

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
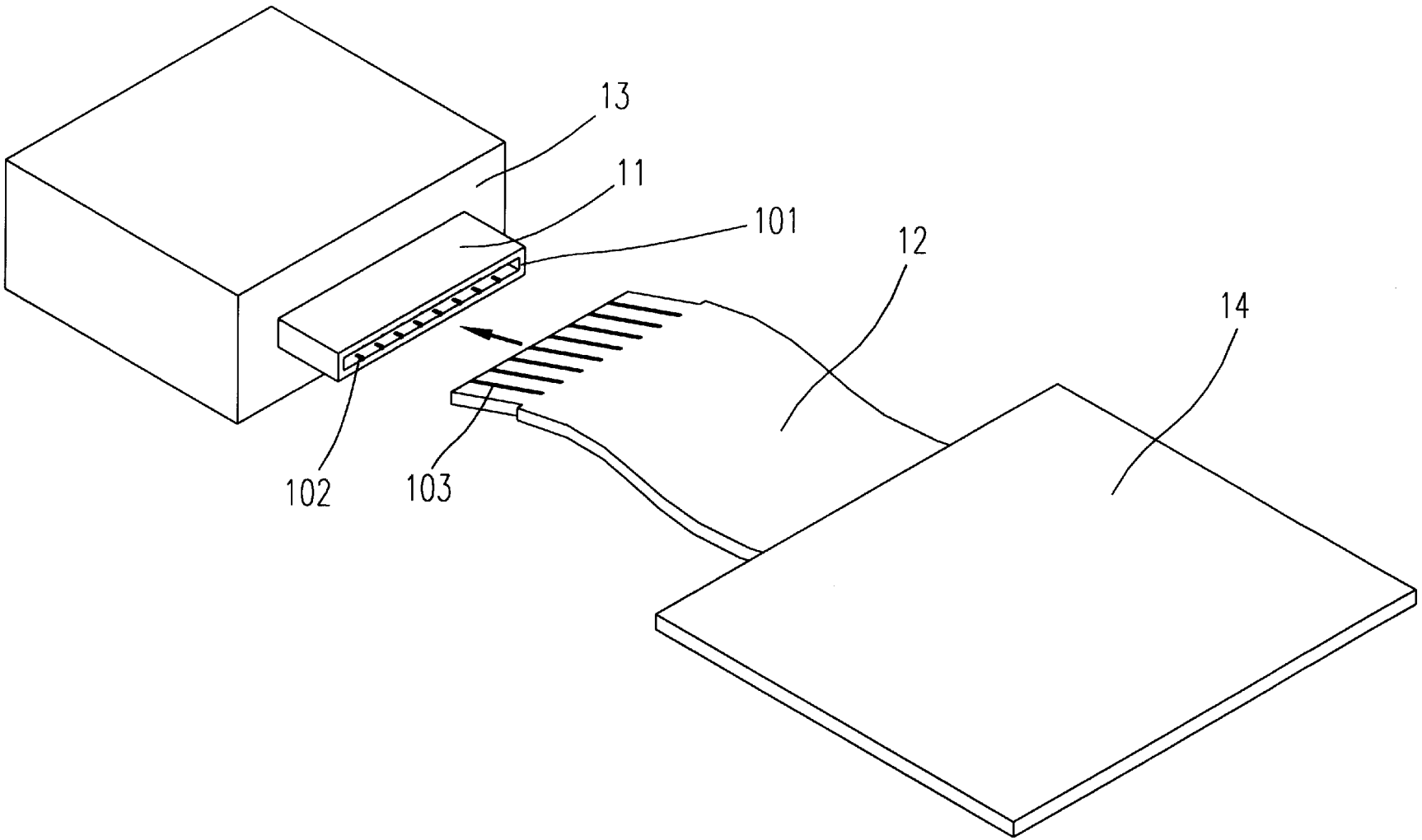
Fig. 1(PRIOR ART)
FIG. 1 is a schematic diagram showing the combination of a conventional connector with a flat cable to connect a power supply with a circuit board.
Figure 2:
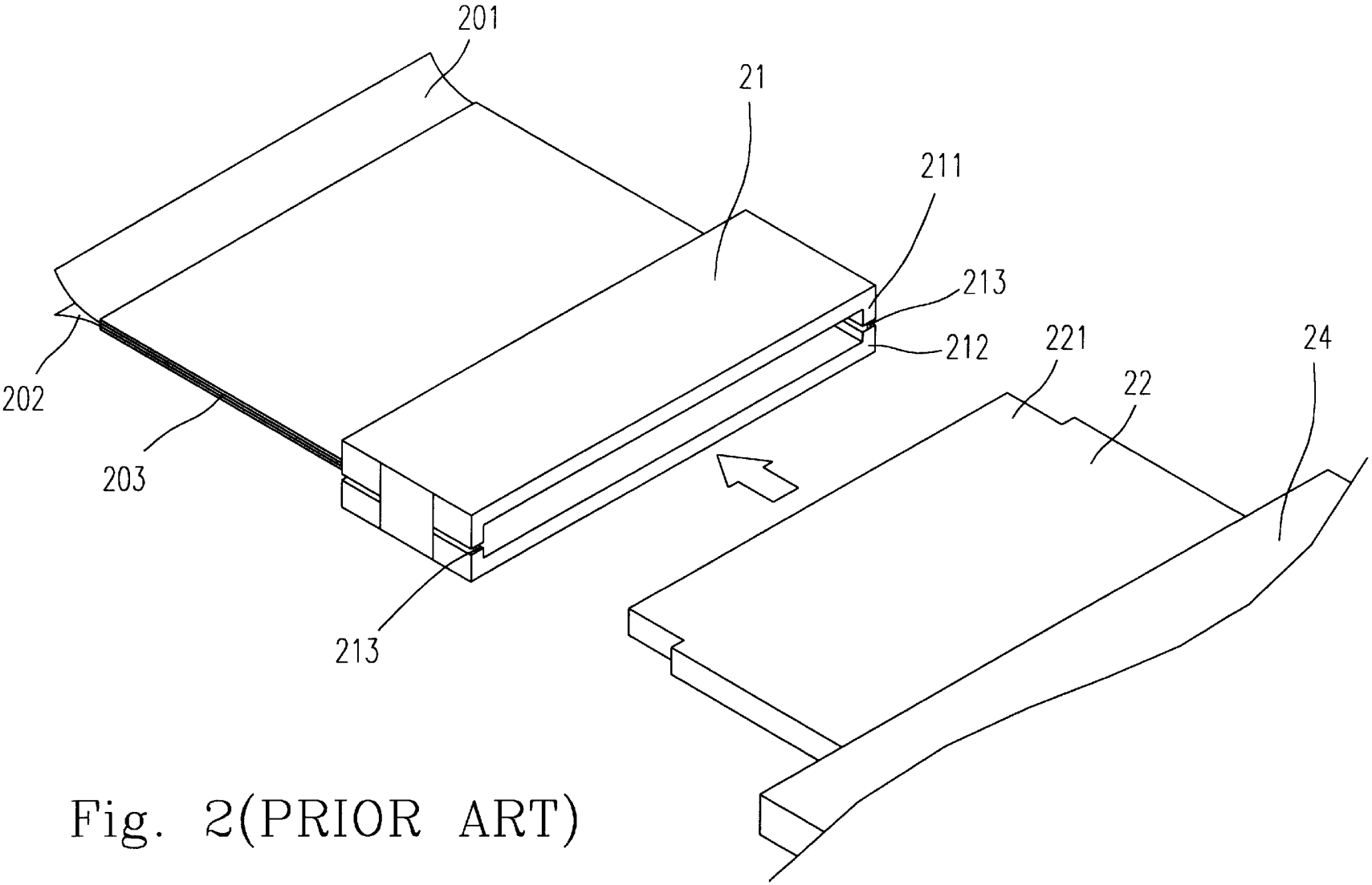
Fig. 2(PRIOR ART)
FIG. 2 is a schematic diagram showing the combination of another conventional connector with a flat cable to connect a power supply with a circuit board.
Figure 3:
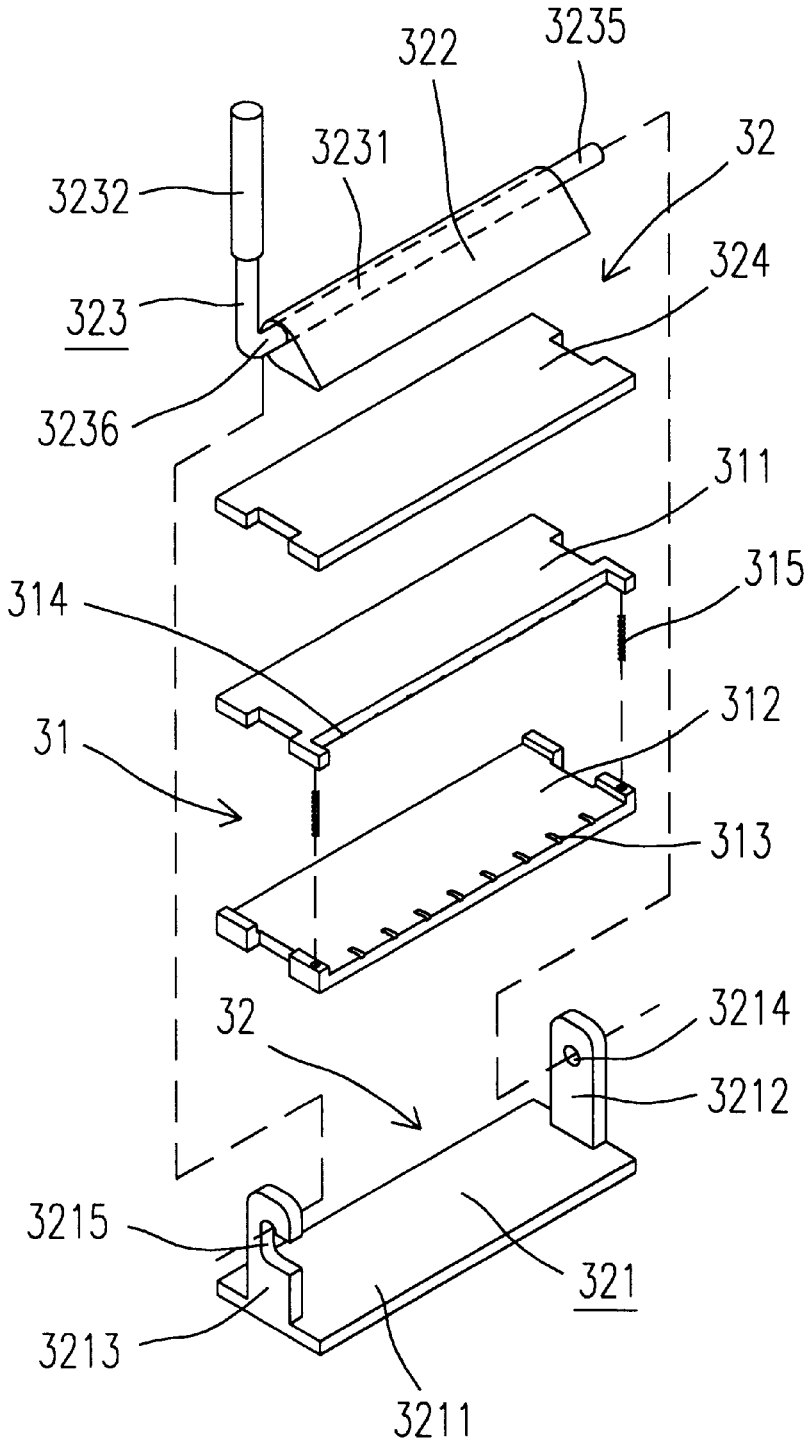
FIG. 3 is a schematic resolved diagram of a first embodiment of a connector according to the present invention.

Please refer to FIG. 3 which is a schematic resolved diagram of a first embodiment of a connector according to the present invention. As shown in FIG. 3, the connector includes a connecting head 31 and an auxiliary device 32. The connecting head 31 includes an upper plate 311 and a lower plate 312. In addition, there are a row of elastic metal strips 314 mounted on the lower surface of the upper plate 311, and another row of elastic metal strips 313 mounted on the upper surface of the lower plate 312. Between the upper plate 311 and the lower plate 312, an elastic element 315 is arranged to adjustably engage the upper plate 311 with the lower plate 312. In this embodiment, two springs are used as the elastic element 315 by being arranged between two sides of the upper and lower plates 311 and 312, respectively, as shown in FIG. 3.

On the other hand, the auxiliary device 32 includes a base 321, a pillar element 322, a draw bar 323 and a force-dispersion plate 324. The draw bar 323 is substantially created from a rod 3235 which is divided into two parts by bending one end thereof. The unbent portion penetrates through the pillar element 322 to serve as a shaft 3231 of the pillar element 322, and the bent portion is sleeved thereon a soft pad to serve as a handle 3232. The base 321 includes a base plate 3211, a first post 3212 having a through hole 3214 and a second post 3213 having a hooked trench 3215. The two posts 3212 and 3213 are located at two sides of the base plate 3211, and protrude from the base plate 3211. For assembling the connector, the lower plate 311, the upper plate 312 engaged with the lower plate 311 by springs 315, and the force-dispersion plate 324 are placed on the base plate 3211 in sequence, and respective two sides of these plates 311, 312 and 324 are coupled to the two posts 3212 and 3213, respectively. Then, the pillar element 322 is secured to the base 321 and placed on the force-dispersion plate 324 by having one end 3235 of the shaft 3231 inserted into the through hole 3214, and the other end 3236 of the shaft 3231 enter the hooked trench 3215 from the opening to be received in the trench. By this way, the assembling of the connector is accomplished.

Figure 4:
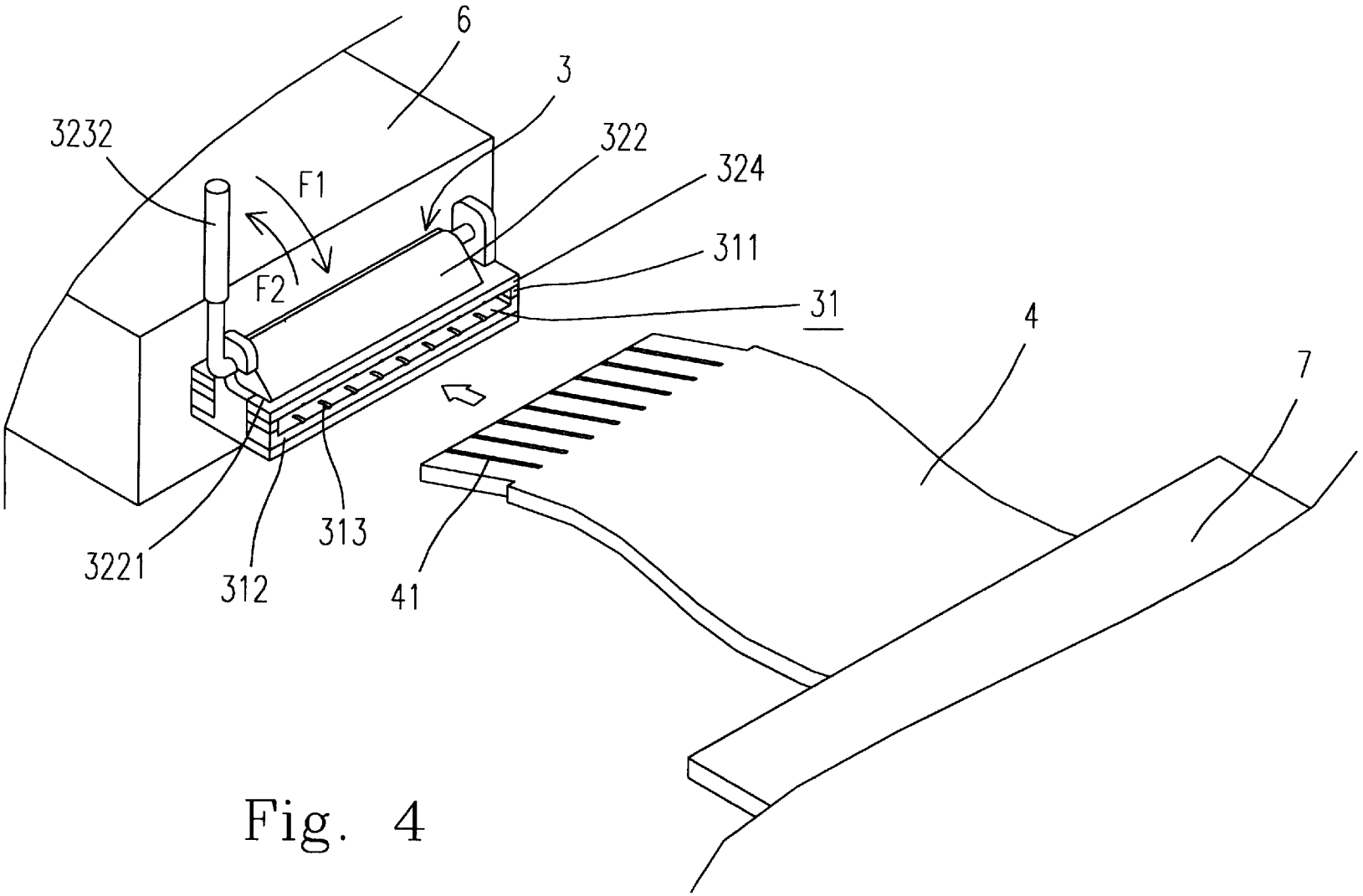
FIG. 4 is a perspective diagram schematically showing the combination of the connector of FIG. 3 with a flat cable to connect a power supply with a circuit board.

Now refer to FIG. 4 which is a perspective diagram schematically showing the combination of the connector 3 of FIG. 3 with a flat cable 4 to connect a power supply 6 with a circuit board 7. In a normal state, i.e. for the situation of no flat cable inserted into the connector, the pillar element 322 is loosely placed on the connecting head 31. When the flat cable 4 is inserted into the connector 3 from the entrance between the upper and the lower plates 311 and 312 of the connecting head 31, the springs 315 (FIG. 3) prop open the entrance to allow the flat cable 4 to enter the connector 3. Therefore, the flat cable 4 can be clamped in the connecting head 31 between the two rows of elastic metal strips 314 by the elastic force of the metal strips 314 as well as the elastic force of the springs 315. Furthermore, a forward force F1 can be exerted on the handle 3232 to pivotally rotate the pillar element 322 to make a surface 3221 of the pillar element 322 depress and sustain against the connecting head 31 through the force-dispersion plate 324 so as to assure of the clamping of the pins 41 of the flat cable 4 between the metal strips 314. The presence of the force-dispersion plate 324 is to make the force F1 transmitted to the connecting head even in order to make each of the pins 41 in close contact with each pair of metal strips 314.

On the other hand, when the flat cable 4 is to be released from the connecting head 31, a backward force F2 is exerted on the handle 3232 to release the sustaining force of the surface 3221 of the pillar element 322 against the connecting head 31 so as to make the clamping force of the flat cable 4 in the connecting head 31 weakened. By this way, the flat cable 4 can be separated from the connector 3 easily.

Figure 5:
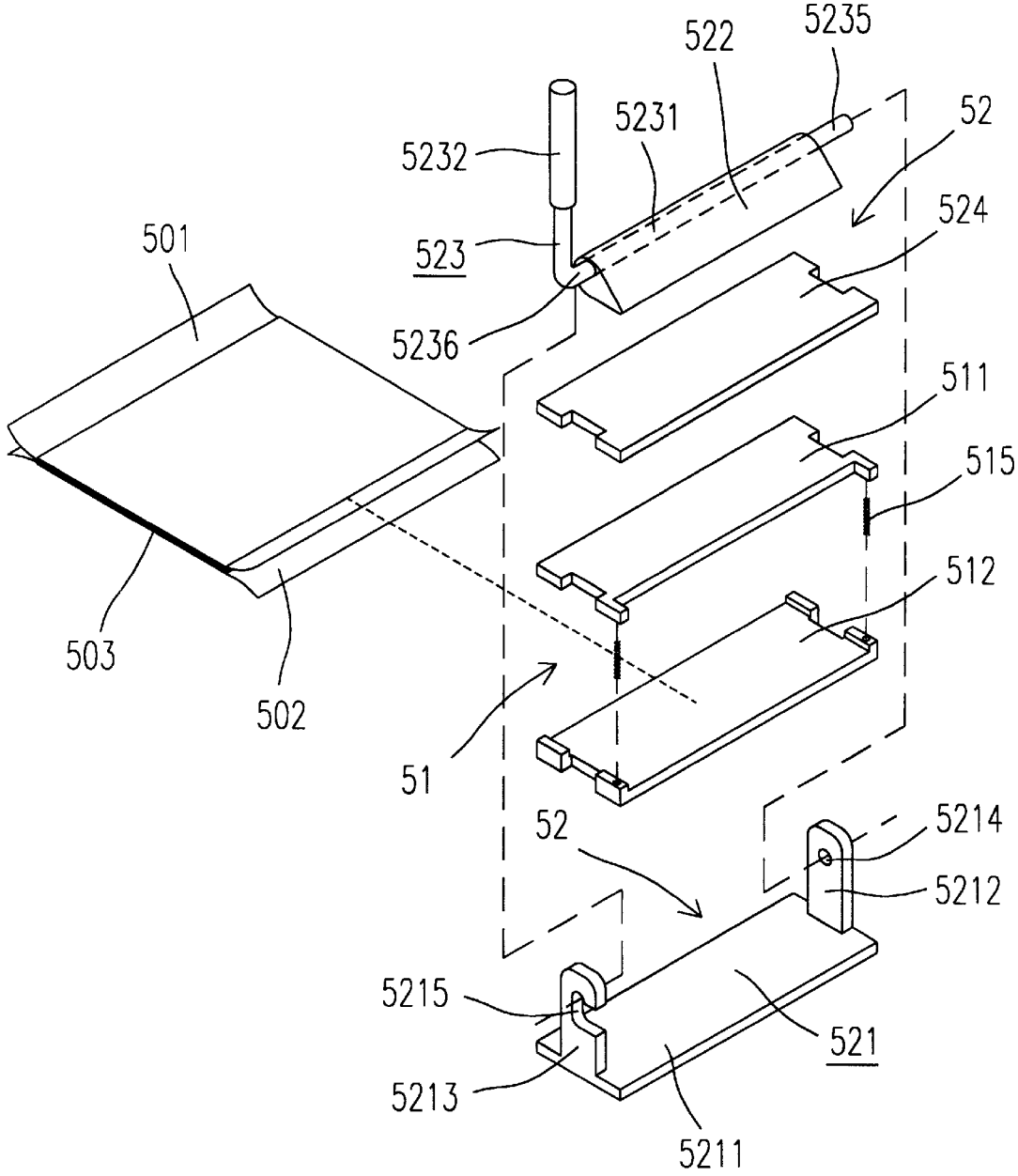
FIG. 5 is a schematic resolved diagram of a second embodiment of a connector according to the present invention.
Figure 6:
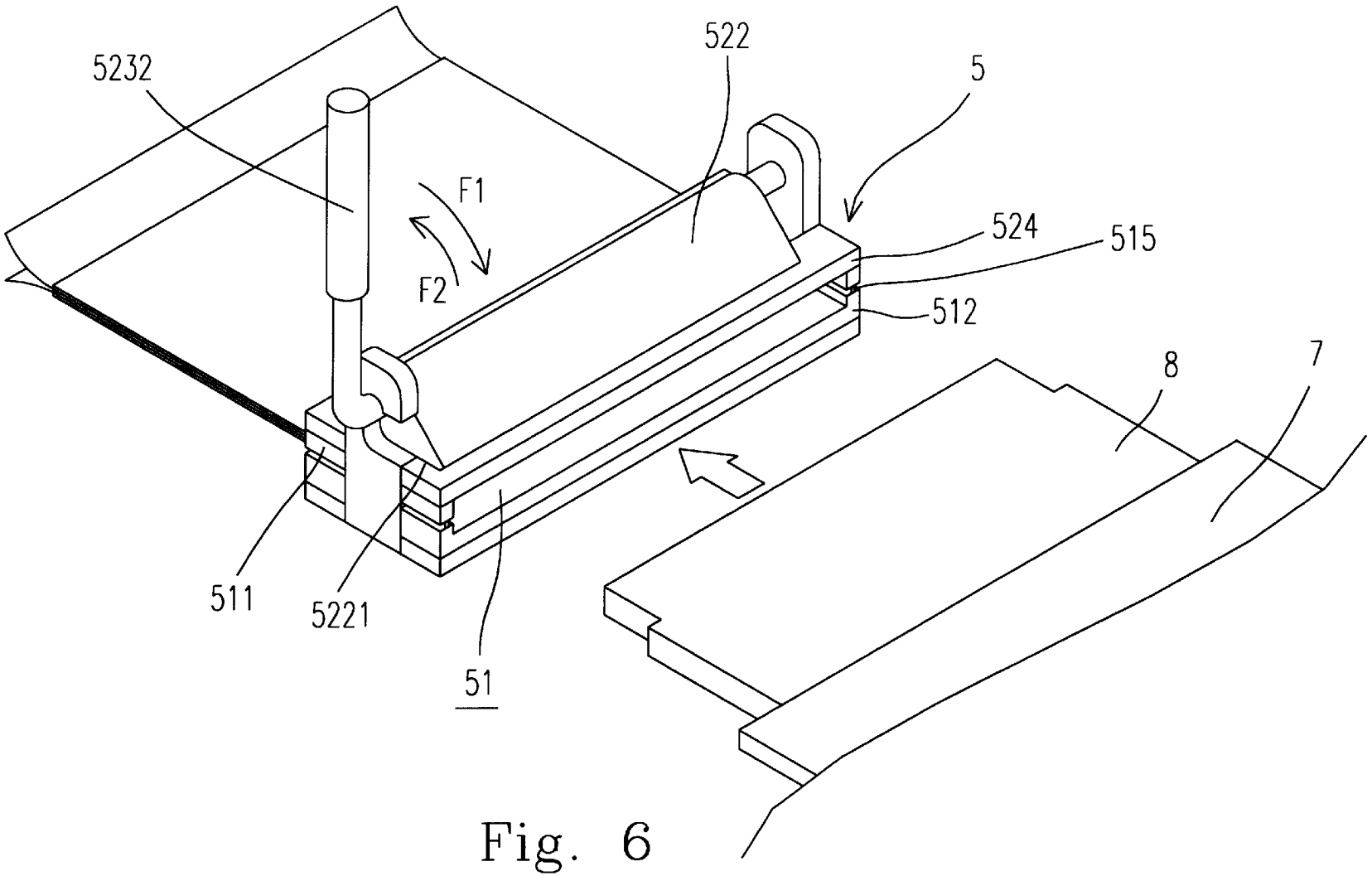
FIG. 6 is a perspective diagram schematically showing the combination of the connector of FIG. 5 with a flat cable to connect a power supply with a circuit board.

A second embodiment of a connector according to the present invention will be illustrated as follows with reference to FIGS. 5 and 6. FIG. 5 is a schematic resolved diagram of a second embodiment of a connector according to the present invention, and FIG. 6 is a perspective diagram schematically showing the combination of the connector of FIG. 5 with a flat cable to connect a power supply with a circuit board.

Similar to the connector as shown in FIG. 3, the connector shown in FIG. 5 includes a connecting head 51 and an auxiliary device 52. The connecting head 51 includes an upper plate 511 and a lower plate 512. Between the upper plate 511 and the lower plate 512, an elastic element 515 is arranged to adjustably engage the upper plate 511 with the lower plate 512. In this embodiment, two springs are used as the elastic element 515 by being arranged between two sides of the upper and lower plates 511 and 512, respectively.

On the other hand, the auxiliary device 52 includes a base 521, a pillar element 522, a draw bar 523 and a force-dispersion plate 524. The draw bar 523 is divided as a shaft 5231 penetrating through the pillar element 522 and a handle 5232 having a non-zero angle with the shaft 5231. The base 521 includes a base plate 5211, a first post 5212 having a through hole 5214 and a second post 5213 having a hooked trench 5215. The two posts 5212 and 5213 are located at two sides of the base plate 5211, and protrude from the base plate 5211. For assembling the connector, the lower plate 511, the upper plate 512 engaged with the lower plate 511 by springs 515, and the force-dispersion plate 524 are placed on the base plate 5211 in sequence, and respective two sides of these plates 511, 512 and 524 are coupled to the two posts 5212 and 5213, respectively. Then, the pillar element 522 is secured to the base 521 and placed on the force-dispersion plate 524 by having one end 5235 of the shaft 5231 inserted into the through hole 5214, and the other end 5236 of the shaft 5231 enter the hooked trench 5215 from the opening to be received in the trench. By this way, the assembling of the connector is accomplished.

It is to be noted that in this embodiment, signal transmission is conducted by conductive layers rather than the metal strips and wires as mentioned above to eliminate the induction effect of wires. Therefore, as shown in FIG. 5, two conductive pieces 501 and 502 having therebetween an insulating layer 503 are connected to the connector by having end portions thereof coupled to the upper and the lower plates 511 and 512 of the connecting head 51, respectively.

Now refer to FIG. 6 which is a perspective diagram schematically showing the combination of the connector 5 of FIG. 5 with a flat cable 8 to connect a power supply (not shown) with a circuit board 7. In a normal state, i.e. for the situation of no flat cable inserted into the connector, the pillar element 522 is loosely placed on the connecting head 51. When the flat cable 8 is inserted into the connector 5 from the entrance between the upper and the lower plates 511 and 512 of the connecting head 51, the springs 515 prop open the entrance to allow the flat cable 8 to enter the connector 5. Therefore, the flat cable 8 can be clamped in the connecting head 51 between the two conductive pieces 501 and 502 by the elastic force of the elastic force of the springs 515. Furthermore, a forward force F1 can be exerted on the handle 5232 to pivotally rotate the pillar element 522 to make a surface 5221 of the pillar element 522 depress and sustain against the connecting head 51 through the force-dispersion plate 524 so as to assure of the clamping of the flat cable 8 between the conductive pieces 501 and 502.

On the other hand, when the flat cable 8 is to be released from the connecting head 51, a backward force F2 is exerted on the handle 5232 to release the sustaining force of the surface 5221 of the pillar element 522 against the connecting head 51 so as to make the clamping force of the flat cable 8 in the connecting head 51 weakened. By this way, the flat cable 8 can be separated from the connector 5 easily.

From the above descriptions on the basis of the preferred embodiments, it is apparent that a connector can be in good mechanical and electronic connection with a flat cable by providing an auxiliary device outside the connecting head to facilitate the clamping of the flat cable in the connecting head. This is especially beneficial to the application of conductive pieces.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A connector for connecting a first device with a second device through a combination thereof with a flat cable of said second device, comprising:

a connecting head for receiving said flat cable therefrom;

a base plate for supporting thereon said connecting head;

a pillar element movably located on said connecting head for being exerted thereon a first directional force to clamp said flat cable in said connecting head, and a second directional force to release said flat cable from said connecting head;

a shaft penetrating through said pillar element;

a handle being a bent portion from a first end of said shaft outside said pillar element, and exerted thereon said first and said second directional forces to pivotally rotating said pillar element via said shaft;

a first post protruding from a first side of said base plate, and having a through hole for being inserted therethrough said shaft at a second end; and a second post protruding from a second side of said base plate, and having a hooked trench for being inserted therefrom and receiving therein said shaft at said first end.

2. The connector according to claim 1 wherein said connecting head includes:

a lower plate coupled to said first and said second posts by respective two sides thereof to be placed between said base plate and said pillar element when said connector is assembled;

an upper plate engaged with said lower plate, and coupled to said first and said second posts by respective two sides thereof to be placed between said base plate and said pillar element when said connector is assembled; and an elastic element mounted between said upper and lower plates to adjustably engage said upper plate with said lower plate.

3. The connector according to claim 2 wherein said elastic element includes two springs arranged between said upper and lower plates at positions adjacent to said first and said second posts, respectively.

4. The connector according to claim 2 wherein said connecting head further includes two rows of elastic metal strips arranged on opposite surfaces of said upper and said lower plates, respectively, for clamping said flat cable therebetween and transmitting signals between said first and said second devices when said flat cable is inserted into said connecting head.

5. The connector according to claim 2 wherein said connecting head is connected to said first device through two conductive pieces coupled to said upper and said lower plates, respectively, so that said flat cable is clamped between said two conductive pieces to transmit signals between said first and said second devices when said flat cable is inserted into said connecting head.

6. The connector according to claim 2 further including a force-dispersion plate coupled to said first and said second posts by respective two sides thereof, and arranged between said upper plate and said pillar element to assure of an even depression force transmitted from said pillar element to said upper plate when said first directional force is exerted.

* * * * *